United States Patent [19]

Fraser et al.

[11] 4,134,552

[45] Jan. 16, 1979

[54] GRINDING MACHINES

[75] Inventors: Stewart P. T. Fraser, Upton-on-Severn; Paul A. Fellowes-Freeman, Barnwood, both of England

[73] Assignee: Simon-Barron Limited, Gloucester, England

[21] Appl. No.: 832,465

[22] Filed: Sep. 12, 1977

[30] Foreign Application Priority Data

Dec. 7, 1976 [GB] United Kingdom ..... 50872/76

[51] Int. Cl.[2] ..... B02C 23/16

[52] U.S. Cl. ..... 241/33; 241/36; 241/73

[58] Field of Search ..... 241/31, 33, 36, 73; 209/255, 256, 258, 379, 491, 496; 210/108; 55/283

[56] References Cited

U.S. PATENT DOCUMENTS

| | | | |
|---|---|---|---|
| 1,784,278 | 12/1930 | Dollinger | 55/283 |
| 2,149,289 | 3/1939 | Hall | 241/49 |
| 3,008,543 | 11/1961 | Bourdale et al. | 55/283 |
| 3,627,211 | 12/1971 | Leach | 241/49 |
| 3,756,416 | 9/1973 | Wood | 55/283 |

*Primary Examiner*—Granville Y. Custer, Jr.
*Attorney, Agent, or Firm*—Norris & Bateman

[57] ABSTRACT

A grinding mill of the kind comprising a generally cylindrical grinding chamber defined by a screen having a shaft supporting a plurality of grinding hammers rotatable therein and being enclosed in a chamber to which suction is applied characterized by the provision of instrumentality for sensing the pressure within the enclosure surrounding the screen and actuating a safety device in the event that the pressure falls below a predetermined value.

8 Claims, 2 Drawing Figures

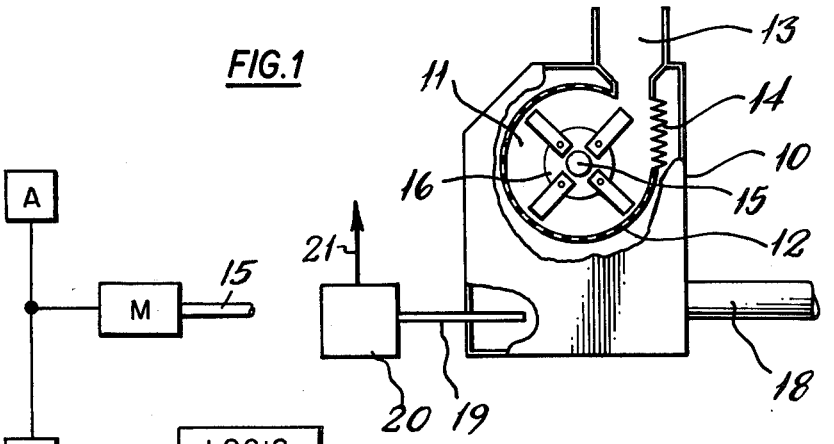
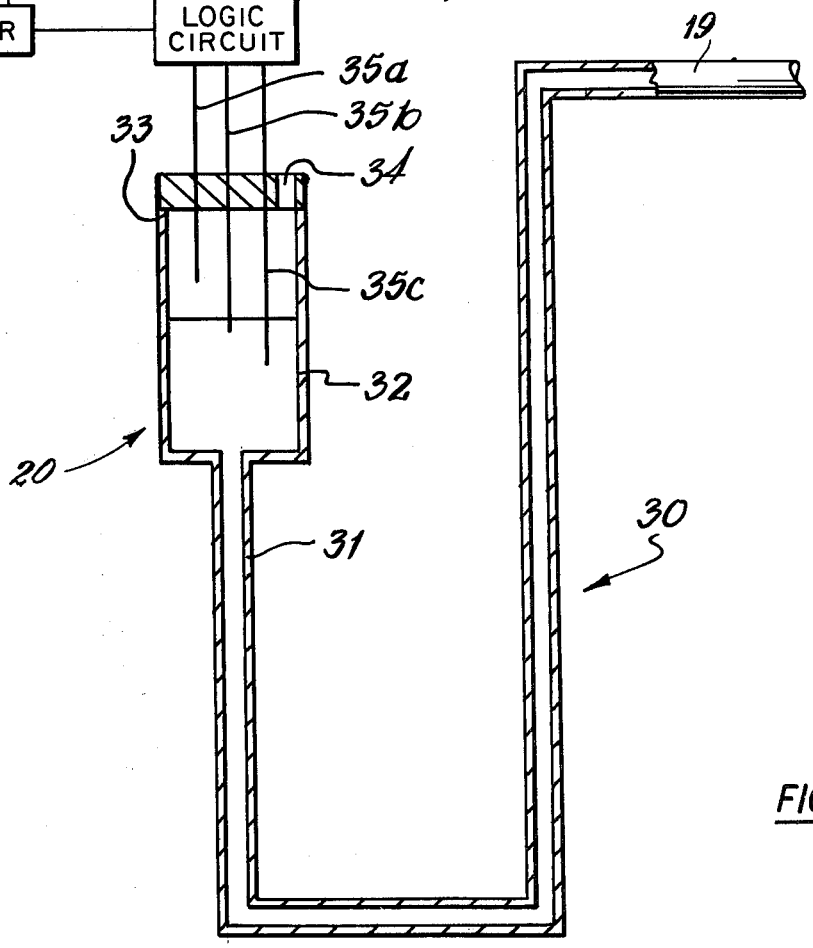
FIG.2

GRINDING MACHINES

This invention concerns a multi-hammer grinding mill of the kind (hereinafter termed of the kind referred to) comprising a generally cylindrical grinding chamber defined by a screen having a shaft supporting a plurality of grinding hammers rotatable therein and being enclosed in a chamber to which suction is applied.

When a grinding mill of the kind referred to is operated normally, the pressure within the enclosure surrounding the screen generally lies within a fairly narrow band. In the event that the screens become progressively blocked for whatever reason, there is a danger of damage to the machine or even fire.

The present invention is based upon an appreciation of the fact that progressive blockage of the screen will be accompanied by a fall in the pressure within the enclosure surrounding the screen.

According to the present invention a grinding mill of the kind referred to is characterised by the provision of means for sensing the pressure within the enclosure surrounding the screen and actuating safety means in the event that the pressure falls below a pre-determined value.

The invention will be further apparent from the following description with reference to the figures of the accompanying drawing which show, by way of example only, one form of grinding mill embodying the invention.

Of the drawing:

FIG. 1 shows a diagrammatic cross-section through the grinding mill; and

FIG. 2 shows on a greatly enlarged scale one form of pressure sensitive device suitable for fitting to the grinding mill of FIG. 1.

Referring now to the drawing, it will be seen that the grinding mill essentially comprises an outer case 10 forming an enclosure for a generally cylindrical grinding chamber 11 disposed with its axis lying horizontally and the major portion of whose periphery is defined by a perforated screen 12. A feed chute 13 is provided for supplying material to be ground to the interior of the grinding chamber. The feed chute 13 extends vertically and communicates with the interior of the grinding chamber 11 in a generally tangential direction above a conventional kibbling plate 14.

A shaft 15 extends along the axis of the grinding chamber and is adapted to be rotated at high speed by motor means (not shown). The shaft 15 carries a plurality of annular discs 16 which are axially spaced from one another, and each axial disc 16 carries a plurality of pivotally mounted grinding hammers 17.

In use, air is exhausted from the enclosure formed by the casing 10 by means of a duct 18 whilst the shaft 15 is rotated at high speed. Material fed into the grinding chamber 11 by way of the chute 13 is comminuted by repeated impacts from the hammers 17 and when comprised by sufficiently small size particles is entrained in the air stream being drawn through the screen 12 for removal through the duct 18 for subsequent separation.

In accordance with the invention a probe 19 extends from a pressure sensitive instrument 20 into the enclosure surrounding the grinding chamber 11 within the case 10.

The pressure sensitive instrument 20 is arranged to produce a signal in line 21 in the event that the pressure within the casing 10 falls below a pre-determined value indicative of partial blockage of the screen 12.

This signal is used to operate some safety mechanism such as an alarm to summon the attention of an operator or a cut-out switch to stop the grinding mill.

Preferably the pressure sensitive instrument 20 also senses a rise in pressure within the casing 10 as would be occasioned if the means establishing the suction through the duct 18 became defective for any reason. Since establishment of the correct air flow through the grinding mill is important for satisfactory operation, such a rise in pressure as detected by the instrument 20 could also be used to generate a signal to operate an alarm or stop the machine.

A particularly convenient and inexpensive form of pressure sensitive instrument is comprised by a liquid-filled manometer tube 30 as shown in FIG. 2. The vertical limb 31 of the manometer tube 30 remote from the probe 19 is equipped with a portion 32 of enlarged diameter closed by a lid 33 having a vent 34 to atmosphere therein. The lid 33 serves to support three vertical wires **35*a*, 35*b* and 35*c* respectively arranged with their lower ends at different heights within the portion 32. The arrangement is such that when the grinding mill is operating normally the liquid filling within the manometer 30 will form a connection between the wires 35*b* and 35*c* of intermediate and maximum depth. In the event that pressure should fall within the casing 10 the level of mercury within the portion 32 will fall causing this connection to be broken, thus to operate a relay causing an alarm to be sounded or the machine to be stopped. As shown in FIG. 2, the wires are operatively connected to a control circuit the output of which is coupled to a relay R that when energized transmits an enabling safety signal to the alarm A or to a cut out switch in the circuit of the motor M that drives shaft 15. Equally, in the event of an increase in pressure within the casing 10 above a predetermined level an electrical connection will be formed between the wires 35*a* and 35*b*** of shortest and intermediate depths respectively, again causing a relay to operate to actuate the alarm or stop the machine.

It will be appreciated that it is not intended to limit the invention to the above example only, many variations, such as might readily occur to one skilled in the art, being possible without departing from the scope thereof, as defined in the appended claims.

What is claimed is:

1. A grinding mill of the kind comprising a generally cylindrical grinding chamber defined by a screen having a shaft supporting a plurality of grinding hammers rotatable therein and being enclosed in a chamber to which suction is applied, and wherein the ground material passes through the screen entrained in an air stream into the surrounding enclosure, characterised by the provision of means for sensing the pressure within the enclosure surrounding the screen and actuating safety means in the event that the pressure falls below a pre-determined value.

2. A grinding mill according to claim 1 wherein said means for sensing the pressure within the enclosure surrounding the screen also operates to actuate said safety means in the event that the pressure rises above a pre-determined value.

3. A grinding mill according to claim 1 wherein said safety means comprises an alarm.

4. A grinding mill according to claim 2 wherein said safety means comprises an alarm.

5. A grinding mill according to claim 1 wherein said safety means comprises means to stop the motor of the grinding mill.

6. A grinding mill according to claim 2 wherein said safety means comprises means to stop the motor of the grinding mill.

7. A grinding mill according to claim 1 wherein said pressure sensing means is comprised by a manometer tube containing mercury and a number of electrical contacts at spaced positions in one limb thereof for sensing the level of mercury in said limb and for operating a relay to actuate said safety means in the event that the level of mercury changes by more than a pre-determined amount.

8. A grinding mill according to claim 2 wherein said pressure sensing means is comprised by a manometer tube containing mercury and a number of electrical contacts at spaced positions in one limb thereof for sensing the level of mercury in said limb and for operating a relay to actuate said safety means in the event that the level of mercury changes by more than a pre-determined amount.

* * * * *